US006553613B2

(12) United States Patent
Onishi et al.

(10) Patent No.: US 6,553,613 B2
(45) Date of Patent: Apr. 29, 2003

(54) ELECTRIC VACUUM CLEANER

(75) Inventors: Yuji Onishi, Sakai (JP); Kazumasa Hayashi, Yamatotakada (JP); Kiyomu Nagai, Nara (JP); Teruhisa Inoue, Osaka (JP); Nobuharu Hikida, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 35 days.

(21) Appl. No.: 09/814,810

(22) Filed: Mar. 23, 2001

(65) Prior Publication Data

US 2001/0023517 A1 Sep. 27, 2001

(30) Foreign Application Priority Data

Mar. 23, 2000 (JP) ..... 2000-087057

(51) Int. Cl.[7] ..... A47L 5/22

(52) U.S. Cl. ..... 15/351; 15/410; 285/7; 285/184

(58) Field of Search ..... 15/410, 351, 415.1; 285/7, 184

(56) References Cited

U.S. PATENT DOCUMENTS

| | | | | | |
|---|---|---|---|---|---|
| 1,110,439 | A | * | 9/1914 | Goughnour | 15/410 |
| 3,065,488 | A | * | 11/1962 | Fischer | 15/328 |
| 3,126,570 | A | * | 3/1964 | Green | 15/331 |
| 3,715,775 | A | * | 2/1973 | Nickelson | 15/324 |
| 4,158,462 | A | * | 6/1979 | Coral | 285/144.1 |
| 4,521,936 | A | * | 6/1985 | Medwed | 15/377 |
| 4,537,424 | A | * | 8/1985 | Maier et al. | 15/377 |

* cited by examiner

*Primary Examiner*—Chris K. Moore
(74) *Attorney, Agent, or Firm*—Birch, Stewart, Kolasch & Birch, LLP

(57) ABSTRACT

An electric vacuum cleaner has a main body incorporating an electric blower, a nozzle unit having a nozzle, and a first and a second connection pipe fitted between the main body and the nozzle unit so as to serve as part of the passage for a dust suction air flow generated by driving the electric blower. The first and second connection pipes are rotatable, and support the main body in a standing position.

9 Claims, 8 Drawing Sheets

(a) (b)

ELECTRIC VACUUM CLEANER

BACKGROUND OF THE INVENTION

1. Field of the Invention

The present invention relates to an electric vacuum cleaner having a dust suction duct that is connected to a nozzle unit.

2. Description of the Prior Art

A conventional electric vacuum cleaner of a so-called upright type is typically composed of a nozzle unit having a nozzle, a main body supported so as to be bendable back and forth with respect to the nozzle unit and incorporating a dust collection bag, and a handle portion by which a user holds the main body so that he can move the electric vacuum cleaner around. Advantageously, when not in use, such an upright-type electric vacuum cleaner can be stored away with its main body in an upright position.

However, to permit such an electric vacuum cleaner to be stored away in an upright position, its heavy main body needs to be supported on its nozzle unit facing the floor surface so that the electric vacuum cleaner does not turn over. Thus, the nozzle unit needs to be made accordingly large, and consequently requires a considerably large storage space.

In addition, since the main body is directly pivoted on the large nozzle unit, electric vacuum cleaners of this type are unfit for the cleaning of narrow spaces such as gaps between pieces of furniture. Some models come with relatively small nozzle units, but they instead require dedicated stands or the like on which they need to be put when stored away. This seriously limits the choice of where to store away such electric vacuum cleaners.

SUMMARY OF THE INVENTION

An object of the present invention is to provide an electric vacuum cleaner that can be stored away with its main body in an upright position, and thus with less space, and that is built in a way advantageous to the downsizing of its nozzle unit.

To achieve the above object, according to the present invention, in an electric vacuum cleaner provided with an electric blower, a nozzle unit having a nozzle, and a dust suction duct fitted between the electric blower and the nozzle unit so as to serve as a passage for a dust suction air flow generated by driving the electric blower, the dust suction duct is bendable at some point along itself and can stand in an upright position by itself. This makes the downsizing of the nozzle unit possible, and in addition permits the electric vacuum cleaner to be stored away almost anywhere and with minimum space when not in use.

The dust suction duct may be composed of a first dust suction duct of which one end is joined to the nozzle unit and a second dust suction duct that is rotatably joined to the other end of the first dust suction duct. This permits the second dust suction duct to be rotated so as to be held in an upright position.

One end of the first dust suction duct may be rotatably joined to the nozzle unit. This makes it possible to rotate the first dust suction duct separately from the rotation of the second dust suction duct.

An electric vacuum cleaner according to the present invention may be further provided with a locking mechanism that, when the first and second dust suction ducts come into a substantially straight state, locks the first and second dust suction ducts to keep them in the substantially straight state. In this arrangement, when the second dust suction duct is rotated so that the first and second dust suction ducts come into a substantially straight state, they are locked in that state. This enhances cleaning efficiency.

The nozzle unit may be removable integrally with the first and second dust suction ducts. This makes it possible to perform cleaning with an auxiliary nozzle, instead of the nozzle unit, fitted to the tip of the dust suction duct.

An electric vacuum cleaner according to the present invention may be further provided with a cyclone-type dust collector portion fitted at some point along the dust suction duct so as to separate the dust sucked in through-the nozzle unit by whirling around the dust suction air flow generated by driving the electric blower.

In this arrangement, the dust suction air flow generated by driving the electric blower turns into a whirling air flow inside the cyclone-type dust collector portion, and the centrifugal force exerted by this whirling air flow separates dust. The dust thus separated is accumulated inside the cyclone-type dust collector portion.

The second dust suction duct may be rotatable up to more than 90 degrees from the position in which the first and second dust suction ducts are in a substantially straight state. In this arrangement, the second dust suction duct, when held in an upright position, inclines toward the nozzle unit and thereby prevents the electric vacuum cleaner from turning over.

An electric vacuum cleaner according to the present invention may be further provided with means for stopping the driving of the electric blower when, at the joint between the first and second dust suction ducts, the second dust suction duct is rotated to a predetermined rotation angle. In this arrangement, when the dust suction duct is obstructed at the joint, even if a power switch for starting the driving of the electric blower is turned on, the electric bower does not start being driven.

A shock absorbing member may be fitted in a portion of the first dust suction duct at which it makes contact with the floor surface. The shock absorbing member absorbs the shock that occurs when the first dust suction duct collides with the floor surface as it is rotated so that the main body is held in an upright position. This prevents the first dust suction duct from being scratched or broken.

A caster may be fitted on the first dust suction duct so as to permit the nozzle unit to be moved around on the floor surface. This permits the nozzle unit to be moved around with the first dust suction duct kept in contact with the floor surface even on a thick-piled carpet, and thus makes cleaning easy.

BRIEF DESCRIPTION OF THE DRAWINGS

This and other objects and features of this invention will become clear from the following description, taken in conjunction with the preferred embodiments with reference to the accompanied drawings in which.

DESCRIPTION OF THE PREFERRED EMBODIMENTS

Figure 1:
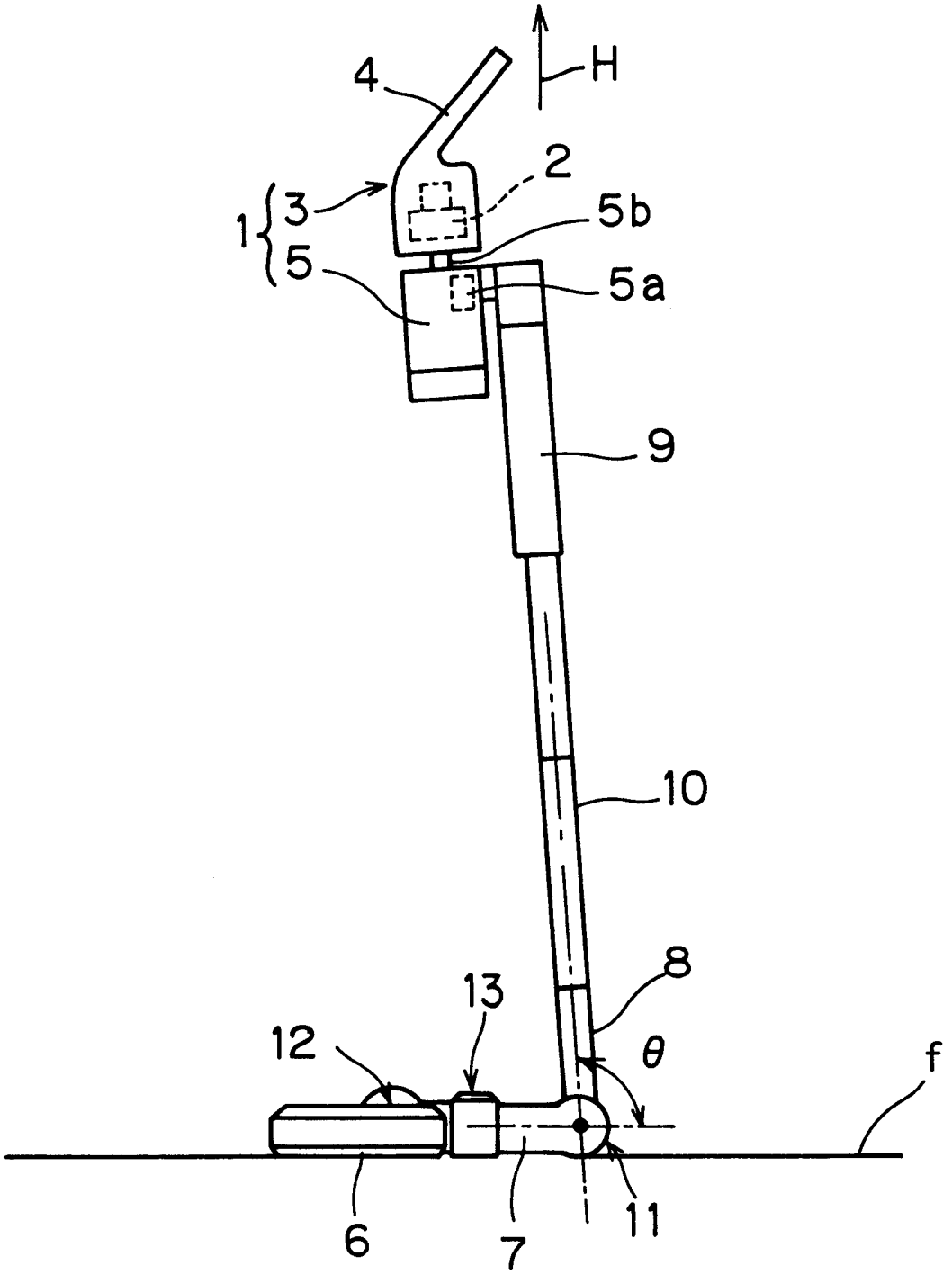
FIG. 1 is a schematic side view of the electric vacuum cleaner of a first embodiment of the invention, showing its state when it is stored away.
Figure 2:
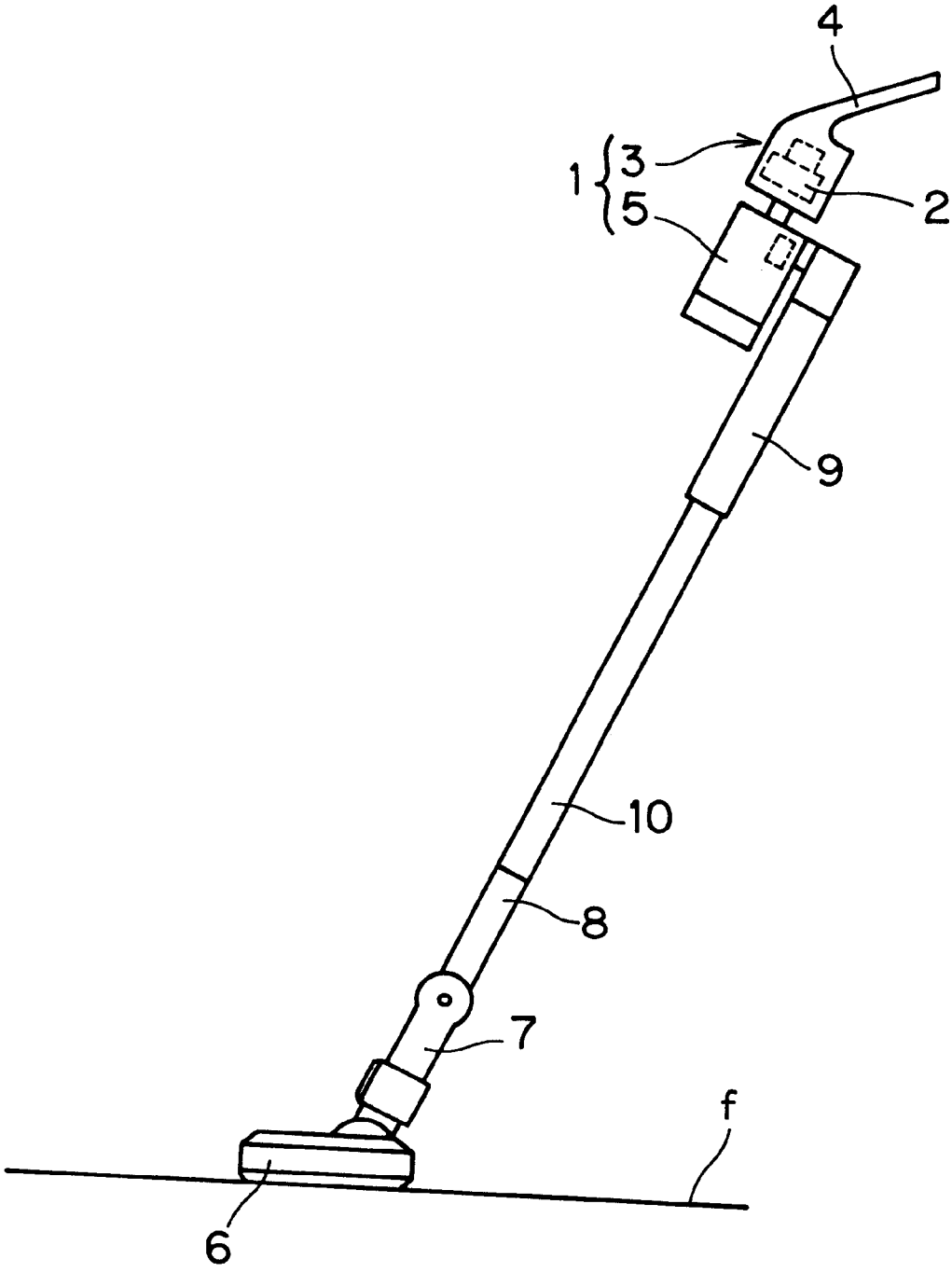
FIG. 2 is a schematic side view of the electric vacuum cleaner of the first embodiment, showing its state when it is used.

A first embodiment of the present invention will be described below with reference to the drawings. FIG. 1 is a diagram schematically showing the outline of the structure of an electric vacuum cleaner embodying the invention, in its state when the main body is held in an upright position.

This electric vacuum cleaner is composed of the following members. A main body 1 consists of a handle portion 3 and a cyclone-type dust collector portion 5. The handle portion 3 incorporates an electric blower 2, and has a grip 4 with an operation portion (not shown) arranged thereon for controlling the operation, for example starting and stopping, of the electric blower 2. The cyclone-type dust collector portion 5 whirls around the dust suction air flow so as to separate dust with the resulting centrifugal force. A nozzle unit 6 has a nozzle (not shown) that faces the floor surface "f" and through which dust is sucked in. A first connection pipe 7 is rotatably supported by the nozzle unit 6. A second connection pipe 8 is rotatably supported by the first connection pipe 7. The main body 1 and the second connection pipe 8 are connected together by an introduction pipe 9 and an extension pipe 10.

The nozzle unit 6 is removable, together with the first and second connection pipes 7 and 8, from the extension pipe 10. This permits an auxiliary nozzle provided as an accessory, such as a crevice tool, to be fitted, instead of the nozzle unit 6 with the first and second connection pipes 7 and 8 joined thereto, at the tip of the extension pipe 10.

The dust suction air flow is introduced through an inlet 5*a* into the cyclone-type dust collector portion 5, which turns the dust suction air flow into a whirling air flow and thereby disperses dust. Thereafter, the dust suction air flow is exhausted out of the main body 1 through an outlet 5*b*. The joint between the first and second connection pipes 7 and 8 forms a first bendable portion 11 (described later). In the electric vacuum cleaner of this embodiment, as shown in the figure, with respect to a substantially straight line along which the second connection pipe 8, the extension pipe 10, and the introduction pipe 9 are arranged, the main body 1 is located on the same side as the nozzle unit 6. Thus, the weight of the main body 1 is borne by the nozzle unit 6. For this reason, to prevent the main body 1 from turning over, the maximum rotation angle θ of the first bendable portion 11 is set to be greater than 90°.

Figure 3:
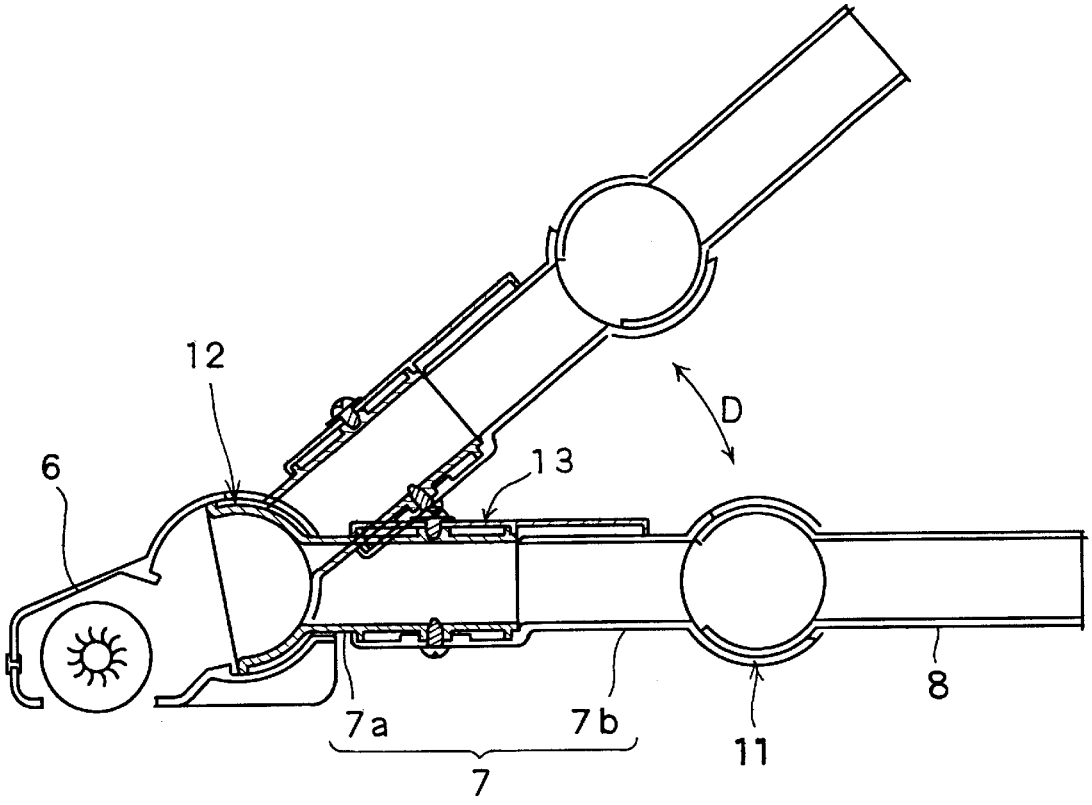
FIG. 3 is a side view of a principal portion of FIG. 2.
Figure 4:
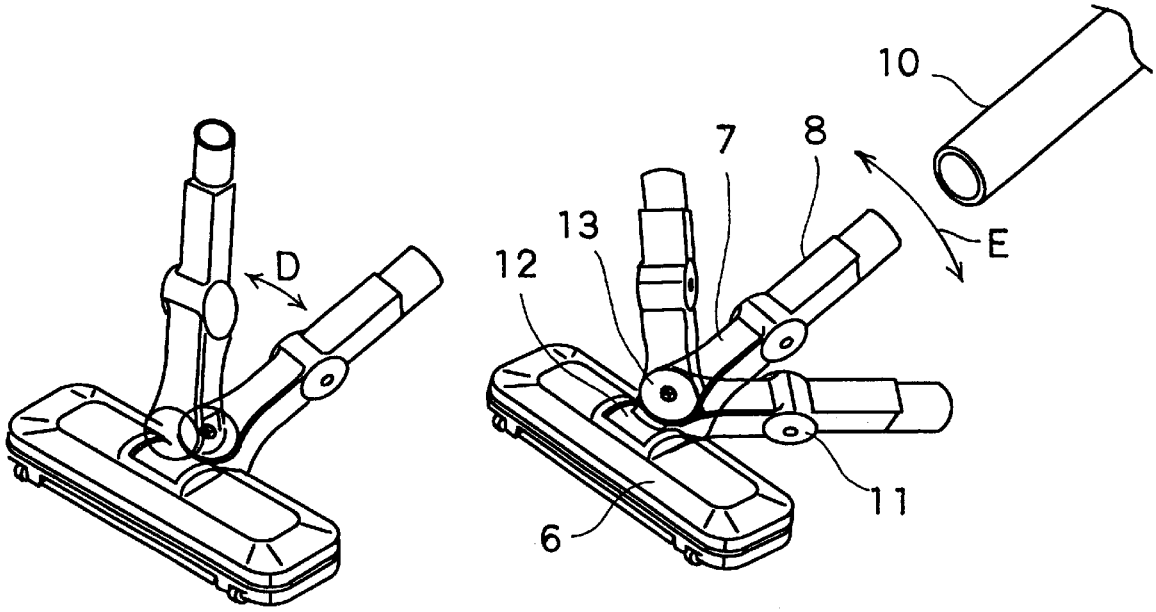
FIGS. 4A and 4B are perspective views of a principal portion of and around the nozzle unit of the electric vacuum cleaner of the first embodiment.

The first connection pipe 7 is rotatable back and forth at a second bendable portion 12 and from side to side at a third bendable portion 13. As shown in FIGS. 3, 4A and 4B, the first connection pipe 7 consists of a first pipe 7*a* that is joined to the nozzle unit 6 so as to be rotatable in the direction marked D at the second bendable portion 12 and a second pipe 7*b* that is joined to the first pipe 7*a* so as to be rotatable in the direction marked E at the third bendable portion 13. Thus, by rotating the first connection pipe 7 at the second and third bendable portions 12 and 13, it is possible to vary the inclination of the first connection pipe 7 back and forth (in the direction D) and from side to side (in the direction E). This makes it possible to perform cleaning with the nozzle unit 6 moved to a narrow space such as a gap between pieces of furniture or under a bed.

Figure 5:
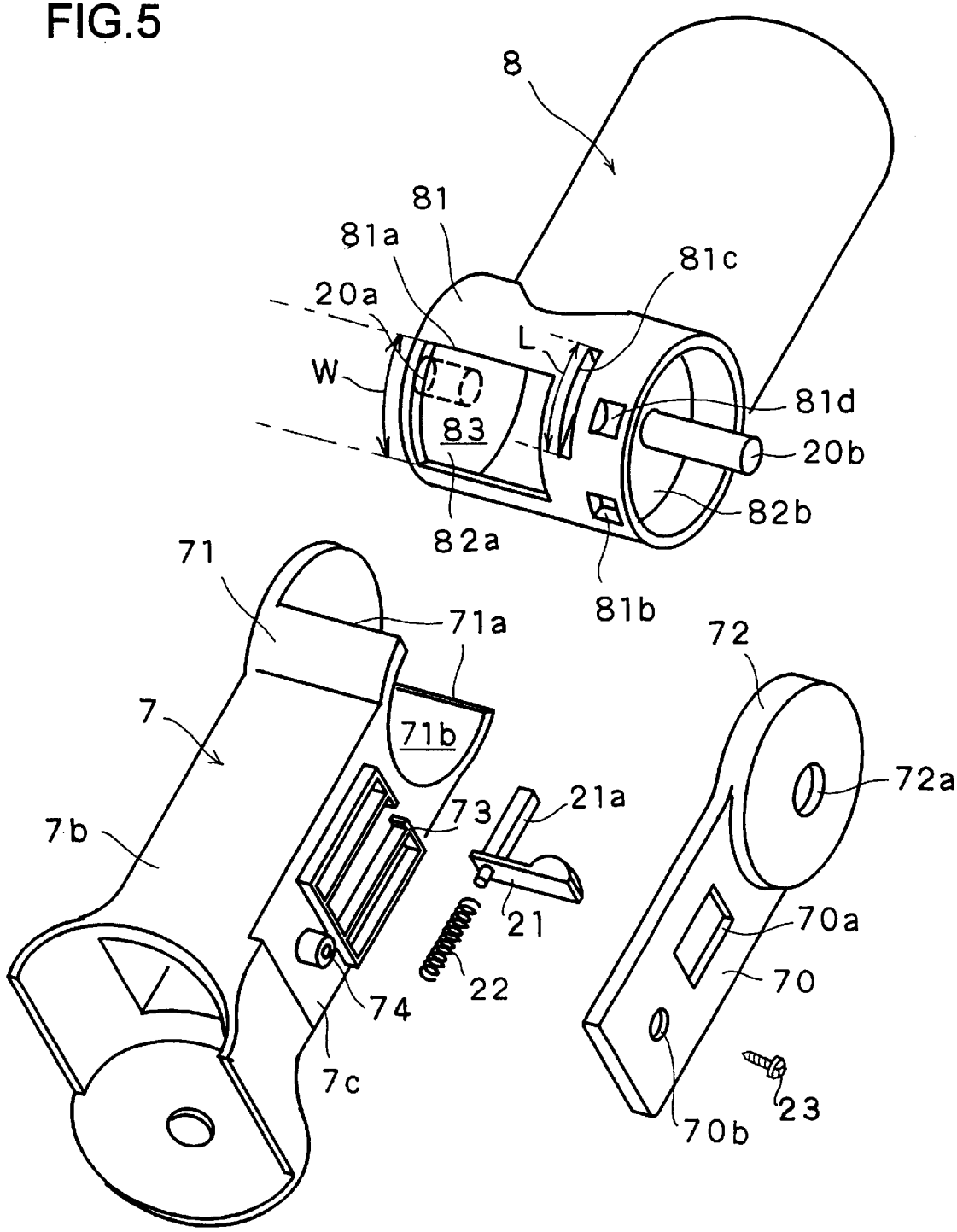
FIG. 5 is an exploded perspective view of the connection pipes joined to the nozzle unit of the electric vacuum cleaner of the first embodiment.

Next, the first bendable portion 11 will be described in detail with reference to an exploded perspective view shown in FIG. 5, a lateral sectional view shown in FIG. 6, and a longitudinal sectional view shown in FIG. 7. The first connection pipe 7 has a first bearing portion 71 formed at one end. This first bearing portion 71 is semi-cylindrical in shape, and has a peripheral wall 71*a* of which a portion is cut out along the periphery of the cylinder so as to form an opening 71*b* that communicates with an opening 81*a* (described later). The first connection pipe 7 has a flat portion 7*c* formed on one side. This flat portion 7*c* has a guide 73 and a screw base 74 formed thereon so as to protrude therefrom, and is used to fit a bearing cover 70 to the first connection pipe 7.

The bearing cover 70 has a second bearing portion 72 substantially cylindrical in shape and having the same internal and external diameters as the first bearing portion 71, a bearing hole 72*a* formed in the second bearing portion 72 so as to rotatably support a rotary shaft 20*b*, an opening 70*a* for restricting the movement stroke of an unlocking lever 21, and a round hole 70*b* through which to put a screw 23 for fixing the bearing cover 70 to the flat portion 7*c*.

On the other hand, the second connection pipe 8 has a cylindrical member 81 formed at one end. This cylindrical member 81 slidably fits between the inward-facing surfaces of the first and second bearing portions 71 and 72. The inside of the cylindrical member 81 is partitioned off by a side wall 82*a* and a partition wall 82*b* so as to form a dust collector portion 83 through which the dust suction air flow passes. The side wall 82*a* and the partition wall 82*b*, both circular in shape, have rotary shafts 20*a* and 20*b* formed at their respective centers so as to protrude therefrom.

In the outer peripheral surface of the cylindrical member 81 are formed a substantially rectangular opening 81*a* that communicates with the dust collector portion 83 and a locking groove 81*b* that engages with a locking pin 21*a* that is formed integrally with the unlocking lever 21. Thus, as the second connection pipe 8 is rotated, the opening 81*a* is gradually closed by the peripheral wall 71*a* of the first bearing portion 71 of the first connection pipe 7. Here, by making the length W of the opening 81 a in the direction of the periphery longer, it is possible to widen the area of the opening 81*a* in that direction so that the second connection pipe 8 is kept communicating with the first connection pipe 7 over a wider range of rotation angles of the second connection pipe 8.

Now, how the first bendable prtion 11 is assembled will be described with reference to FIGS. 5 and 6. The rotary shaft 20*a* is put through the bearing hole (not shown) formed in the first bearing portion 71 of the first connection pipe 7, and the cylindrical member 81 of the second connection pipe 8 is slidably fitted in the first bearing portion 71 of the first connection pipe 7. Thereafter, a spring 22 and the unlocking lever 21 are fitted in the guide 73, and then the rotary shaft 20*b* and the unlocking lever 21 are put respectively through the bearing hole 72*a* of the second bearing portion 72 and through the opening 70*a*. Thereafter, the screw 23 is put through the round hole 70*b* and is screwed into the screw base 74 so that the bearing cover 70 is fixed on the flat portion 7*c*. In this way, the first and second connection pipes 7 and 8 are rotatably joined together so as to form a dust suction air passage through which they communicate with each other.

Figure 6:
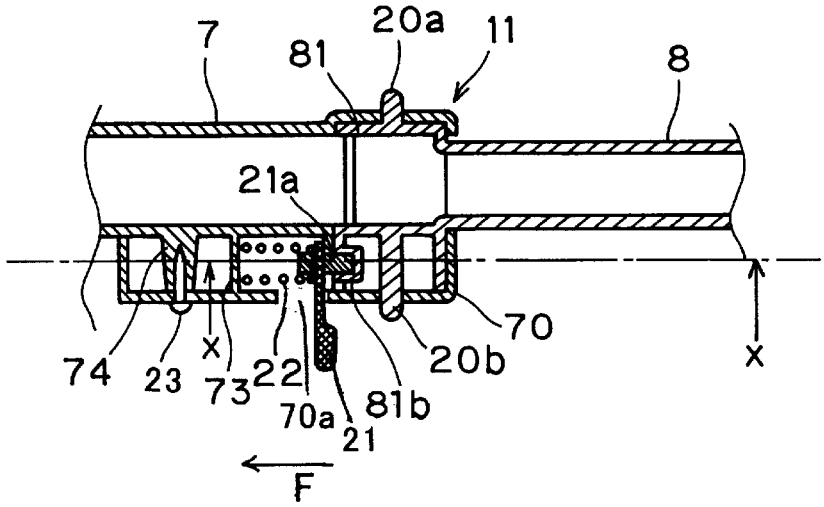
FIG. 6 is a lateral sectional view of a principal portion of the connection pipes shown in FIG. 5.
Figure 7:
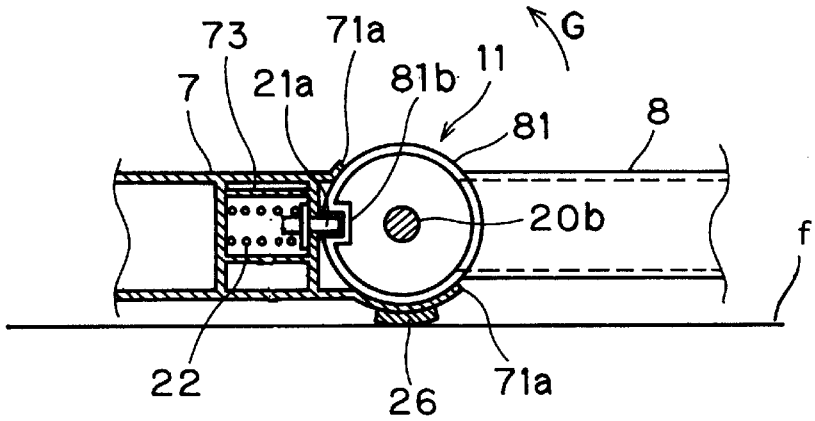
FIG. 7 is a sectional view taken along line x—x shown in FIG. 6.

When the second connection pipe 8 is rotated until it forms a substantially straight line with the first connection pipe 7, as shown in FIGS. 6 and 7, the locking pin 21*a*, which is loaded with a force by the spring 22 so as to pop out toward the cylindrical member 81, engages with the locking groove 81*b*. This prevents further rotation of the second connection pipe 8 at the first bendable portion 11. Reference numeral 26 represents a shock absorbing member that prevents the portion of the first connection pipe 7 at which it makes contact with the floor surface from being scratched or broken. The shock absorbing member 26 is made of an elastic material such as raised fabric, rubber, foam material, or soft resin.

Figure 8:
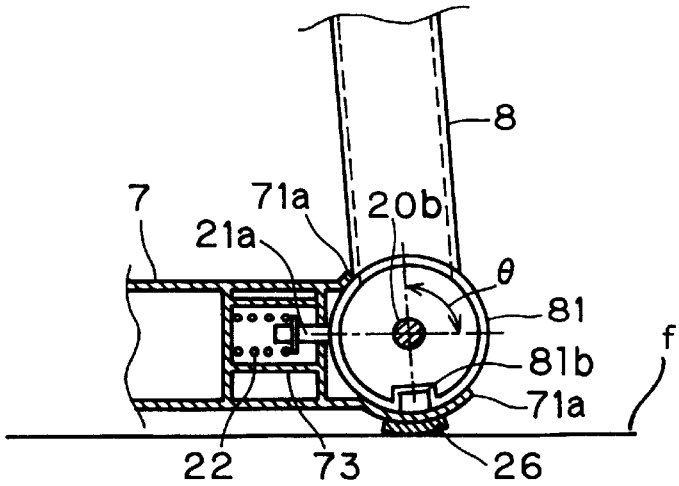
FIG. 8 is a sectional side view of a principal portion of the connection pipes shown in FIG. 5, showing their state when one of them is rotated.

When the electric vacuum cleaner is not in use, the unlocking lever 21 is pressed in the direction marked F (FIG. 6) against the force exerted by the spring 22, so that the locking pin 21*a* disengages from the locking groove 81*b*. In this state, the second connection pipe 8 can be rotated in the direction marked G (FIG. 7) up to the position in which, as shown in FIG. 8, the second connection pipe 8 is held in an upright position.

The locations of the ends of the peripheral wall 71*a* of the first bearing portion 71 (FIG. 5) in the direction of the periphery thereof are so set that the maximum rotation angle θ (FIG. 8) of the second connection pipe 8 (i.e. the angle through which the second connection pipe 8 can be rotated about the rotary shafts 20*a* and 20*b* thereof with respect to the first connection pipe 7) is greater than 90°. This prevents the main body 1 (FIG. 1) from turning over.

However, when the electric vacuum cleaner is stored away after simply the second connection pipe 8 is rotated so that the main body (FIG. 1) is held in an upright position, at the first bendable portion 11, the opening 81 a is closed by the peripheral wall 71 of the first bearing portion 71, and thus the dust suction air passage is obstructed. In this state, if the electric vacuum cleaner is connected to a power outlet and a power switch (not shown) provided on the handle portion (FIG. 1) is turned on to start driving the electric blower 2 (FIG. 1), it is impossible to collect dust from the floor surface "f" with a dust suction air flow. This produces a vacuum on the downstream side of the electric blower 2, which not only causes malfunctioning or failure of the electric vacuum cleaner, but also poses danger to the user.

Figure 9:
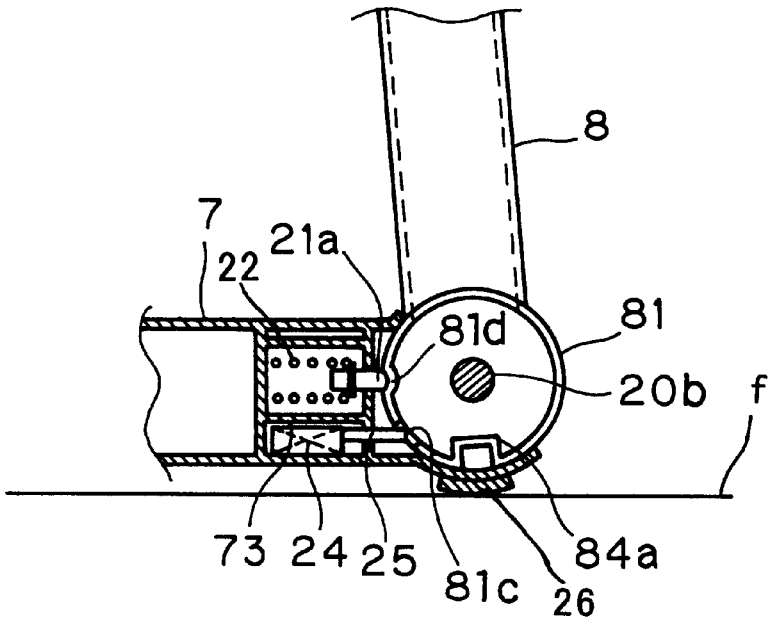
FIG. 9 is a sectional side view of a principal portion of the connection pipes shown in FIG. 5, showing another example of their state when one of them is rotated.

To prevent this, as shown in FIG. 9, in the first connection pipe 7, a safety switch 24 for turning on and off the driving of the electric blower 2 is fitted, with its switch rod 25 protruding therefrom so as to pop out toward the cylindrical member 81. When the second connection pipe 8 is rotated to the upright position, the switch rod 25 engages with a safety switch groove 81*c* formed in the outer peripheral surface of the cylindrical member 81, and thereby the safety switch 24 is turned off. As a result, when the main body (FIG. 1) is held in an upright position, even if the switch for starting the electric blower 2 (FIG. 1) is operated, the electric blower 2 is not driven. This makes it possible to realize an electric vacuum cleaner that is highly safe to use. By configuring the safety switch 24 so as to stop not only the driving of the electric blower 2 but also the supply of electric power to all electric components, it is possible to realize higher safety.

By varying the length L (FIG. 5) of the safety switch groove 81*c* in the direction of the periphery, it is possible to freely vary the range of rotation angles of the second connection pipe 8 within which the switch rod 25 of the safety switch 24 reaches into the safety switch groove 81*c*. This makes it possible to turn the safety switch 24 off and thereby prevent the driving of the electric blower 2 before the second connection pipe 8 is rotated up to the end of its rotation angle range, i.e. at some point in the middle of its rotation angle range.

Furthermore, in the outer peripheral surface of the cylindrical member 81 (FIG. 5), a groove 81*d* is formed with which the locking pin 21*a* engages when the second connection pipe 8 is rotated to the upright position, i.e. up to the end of its rotation angle range. This ensures that the second connection pipe 8 is held securely in this position, and thus effectively prevents the main body 1 (FIG. 1) from turning over. Moreover, thanks to this engagement, even when the grip 4 of the handle portion 3 is lifted up in the direction marked H in FIG. 1, the second connection pipe 8 remains locked. This prevents the nozzle unit 6 from dangling about, and thereby permits the electric vacuum cleaner to be brought around securely.

Figure 10:
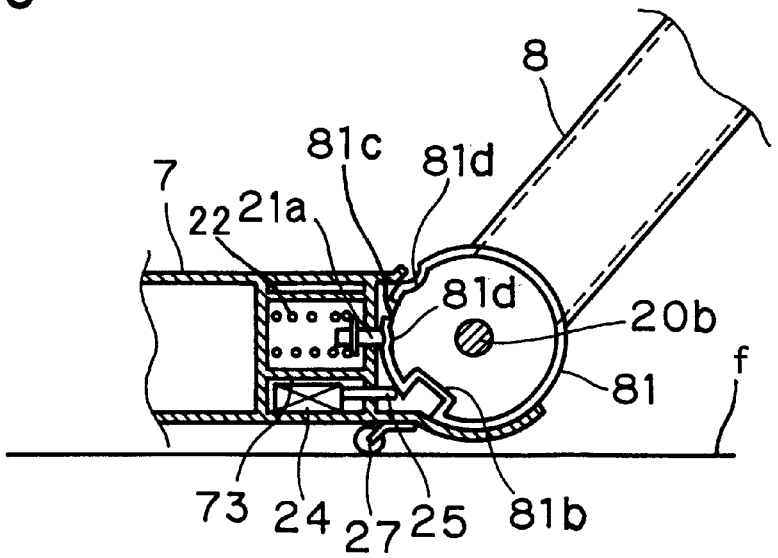
FIG. 10 is a sectional side view of a principal portion of the connection pipes shown in FIG. 5, showing still another example of their state when one of them is rotated.

As shown in FIG. 10, the locking pin 21*a* is so formed as to have an inclined or rounded tip, and is pressed by the spring 22 into the groove 81*d* formed in the outer peripheral surface of the cylindrical member 81 so that the locking pin 21*a* engages with the groove 81*d* in such a way as to disengage therefrom readily when the second connection pipe 8 is rotated. Thus, the locking pin 21 a runs onto the outer peripheral surface of the cylindrical member 81 as soon as the second connection pipe 8 is rotated. This eliminates the need to operate the unlocking lever 21 every time the locking pin 21 a is unlocked, and thereby makes the electric vacuum cleaner easier to use.

Instead of the shock absorbing member 26, a caster 27 that rolls as it rotates may be fitted in the portion of the first dust suction duct 7 at which it makes contact with the floor surface. This makes it possible to move around the electric vacuum cleaner while keeping the main body 1 in an upright position without lifting it up. Moreover, it is possible to perform cleaning with the second connection pipe 8 locked at some point in the middle of its rotation angle range, and thus it is easy to perform cleaning on a thick-piled carpet or the like.

The engagement of the locking pin 21*a* with the groove 81*d* is weaker than that with the locking groove 81*b*, and in addition the locking pin 21*a* has its tip so shaped as to ease disengagement. Thus, without pressing the unlocking lever 21, simply by rotating the second connection pipe 8 in the direction D, it is possible to change the position of the main body 1 between the position it takes when the electric vacuum cleaner is stored away (see FIG. 1) and the position it takes when the electric vacuum cleaner is in use.

As the groove 81*d*, a plurality of grooves may be formed in the outer peripheral surface of the cylindrical member 81 within the range of rotation angles of the second connection pipe 8. This permits the second connection pipe 8 to be rotated to and held at the desired angle stepwise according to the conditions, such as the condition of the surface to be cleaned, under which cleaning is performed. This makes the electric vacuum cleaner still easier to use.

Figure 11:
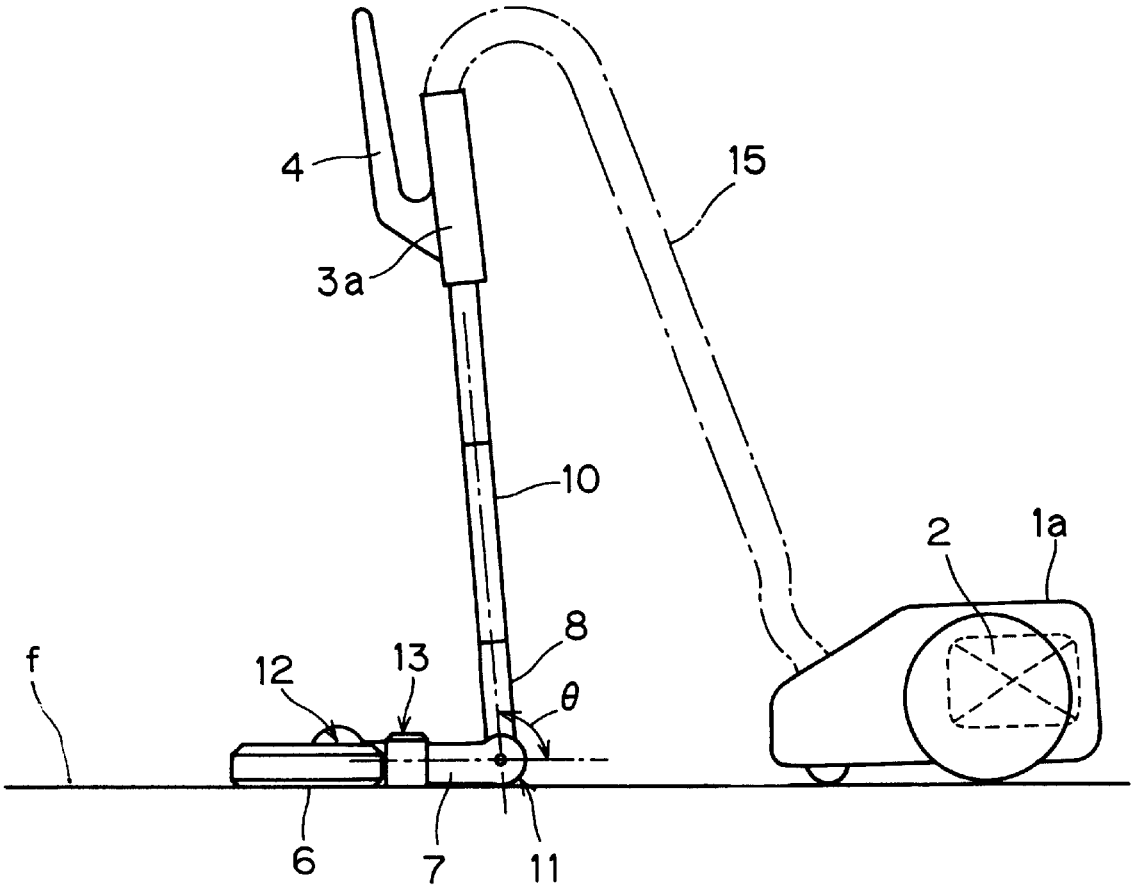
FIG. 11 is a schematic side view of the electric vacuum cleaner of a second embodiment of the invention, showing its state when it is stored away

A second embodiment of the present invention will be described below with reference to FIG. 11. In FIG. 11, such members as are found also in the electric vacuum cleaner of the first embodiment described previously are identified with the same reference numerals, and their detailed explanations will not be repeated. As shown in FIG. 11, in this embodiment, an electric vacuum cleaner of a so-called canister type, composed of a main body 1*a* incorporating an electric blower 2, a handle portion 3*a* having a grip 4, and a flexible suction hose 15 connecting the handle portion 3*a* to the main body 1*a*, is so structured that, exactly as in the first embodiment, the second connection pipe 8 is rotatable at the first bendable portion 11 so as to be held in an upright position together with the extension pipe 10 and the handle portion 3.

In this embodiment, the electric vacuum cleaner can be stored away with the nozzle unit 6, the first and second connection pipes 7 and 8, the extension pipe 10, the handle portion 3*a*, and the suction hose 15, which together form a dust suction air passage, joined together and held in an upright position. This not only permits the electric vacuum cleaner to be stored away with minimum space, but also eliminates the need to join those members together when the electric vacuum cleaner is used next time, and thereby makes it possible to start cleaning quickly.

What is claimed is:

1. An electric vacuum cleaner comprising an electric blower, a nozzle unit having a nozzle, and a dust suction duct fitted between the electric blower and the nozzle unit so as to serve as a passage for a dust suction air flow generated by driving the electric blower, wherein the dust suction duct is rigid and bendable at a point along itself and can stand in an upright position by itself when secured to the nozzle, wherein the dust suction duct has a first dust suction duct of which one end is joined to the nozzle unit and a second dust suction duct is rotatably joined to another end of the first dust suction duct.

2. An electric vacuum cleaner as claimed in claim 1, wherein said one end of the first dust suction duct is rotatably joined to the nozzle unit.

3. An electric vacuum cleaner as claimed in claim 1, further comprising:

a locking mechanism that, when the first and second dust suction ducts come into a substantially straight state, locks the first and second dust suction ducts to keep them in said substantially straight state.

4. An electric vacuum cleaner as claimed in claim 1, wherein the nozzle unit and the first and second dust suction ducts are removable together as a unit.

5. An electric vacuum cleaner comprising an electric blower, a nozzle unit having a nozzle, and a dust suction duct fitted between the electric blower and the nozzle unit so as to serve as a passage for a dust suction air flow generated by driving the electric blower, wherein the dust suction duct is rigid and bendable at a point along itself and can stand in an upright position by itself when secured to the nozzle, further comprising:

a cyclone-type dust collector portion fitted at a point along the dust suction duct so as to separate dust sucked in through the nozzle unit by whirling around the dust suction air flow generated by driving the electric blower.

6. An electric vacuum cleaner as claimed in claim 1, wherein the second dust suction duct is rotatable to at least 90 degrees from a position in which the first and second dust suction ducts are in a substantially straight state.

7. An electric vacuum cleaner as claimed in claim 1, further comprising:

means for stopping the driving of the electric blower when, the second dust suction duct is rotated to a predetermined rotation angle.

8. An electric vacuum cleaner as claimed in claim 1, further comprising:

a shock absorbing member fitted on a portion of the first dust suction duct at which the first dust suction duct makes contact with a floor surface.

9. An electric vacuum cleaner as claimed in claim 1, further comprising:

a caster fitted on the first dust suction duct so as to permit the nozzle unit to be moved around on a floor surface.

* * * * *